US008485114B2

(12) United States Patent
Fukao

(10) Patent No.: US 8,485,114 B2
(45) Date of Patent: Jul. 16, 2013

(54) NEEDLE PLATE AND SEWING MACHINE

(75) Inventor: Hiroaki Fukao, Kasugai (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 146 days.

(21) Appl. No.: 13/151,719

(22) Filed: Jun. 2, 2011

(65) Prior Publication Data

US 2011/0297063 A1 Dec. 8, 2011

(30) Foreign Application Priority Data

Jun. 4, 2010 (JP) ..... 2010-128826

(51) Int. Cl.
*D05B 73/12* (2006.01)
*D05B 73/00* (2006.01)

(52) U.S. Cl.
USPC ..... 112/260

(58) Field of Classification Search
USPC ..... 112/260, 261, 324
See application file for complete search history.

(56) References Cited

U.S. PATENT DOCUMENTS

| | | | | |
|---|---|---|---|---|
| 1,262,114 | A | 4/1918 | Smallbone | |
| 3,011,463 | A | 12/1961 | Fuj ita | |
| 3,131,660 | A | 5/1964 | Idomoto | |
| 4,395,962 | A | 8/1983 | Odermann | |
| 4,646,665 | A | 3/1987 | Jimenez | |
| 4,694,763 | A * | 9/1987 | Adams | 112/184 |
| 7,021,226 | B2 | 4/2006 | Tseng | |
| 7,194,969 | B2 | 3/2007 | Niizeki et al. | |
| 8,082,865 | B2 * | 12/2011 | Tseng et al. | 112/302 |
| 2006/0213410 | A1 | 9/2006 | Niizeki et al. | |
| 2010/0175601 | A1 | 7/2010 | Fukao | |

FOREIGN PATENT DOCUMENTS

| | | | |
|---|---|---|---|
| JP | U-43-7770 | | 4/1968 |
| JP | U-63-136590 | | 9/1988 |
| JP | U-02-119175 | | 9/1990 |
| JP | U-4-103879 | | 9/1992 |
| JP | A-2000-237483 | | 9/2000 |
| JP | 02002336579 | A * | 11/2002 |
| JP | A-2003-049812 | | 2/2003 |
| JP | A-2006-238150 | | 9/2006 |
| JP | A-2006-263072 | | 10/2006 |
| JP | A-2008-207946 | | 9/2008 |
| JP | A-2010-158458 | | 7/2010 |

OTHER PUBLICATIONS

Office Action issued in Japanese Patent Application No. 2009-003468 dated May 10, 2011 (with translation).

(Continued)

*Primary Examiner* — Ismael Izaguirre
(74) *Attorney, Agent, or Firm* — Oliff & Berridge, PLC

(57) ABSTRACT

A needle plate includes a first needle plate secured on a bed and a second needle plate detachably attached to the first needle plate. An engagement mechanism includes an engagement member formed at the first needle plate and an engagement subject member formed at the second needle plate, and retains the second needle plate with the first needle plate through engagement of the engagement member and the engagement subject member. A switching element switches positioning of the second needle plate relative to the first needle plate, wherein when in a first position, the second needle plate is secured in contact with the first needle plate with the engagement mechanism engaged, and when in a second position, the second needle plate is distanced from the first needle plate.

9 Claims, 13 Drawing Sheets

OTHER PUBLICATIONS

U.S. Appl. No. 13/310,198, filed Dec. 2, 2011 in the name of Kenichi Mizuno et al.

Office Action dated Jan. 9, 2012 issued in U.S. Appl. No. 12/654,550.

Notification of Reasons for Refusal for corresponding Japanese Patent Application No. 2009-003468, mailed on Nov. 24, 2010 (w/ English translation).

* cited by examiner

NEEDLE PLATE AND SEWING MACHINE

CROSS-REFERENCE TO RELATED APPLICATION(S)

This application is based upon and claims the benefit of priority from the prior Japanese Patent Application 2010-128826, filed on Jun. 4, 2010, the entire contents of which are incorporated herein by reference.

FIELD

The present disclosure relates to a needle plate provided with a first needle plate fixed to a sewing machine bed and a second needle plate detachably attached to the first needle plate.

BACKGROUND

Needle plates provided in conventional sewing machines are screw fastened to the upper surface of the sewing machine bed. Such needle plates are typically provided with a needle hole allowing penetration of a sewing needle and angular holes through which a feed dog for feeding a workpiece cloth is driven up and down. Within the bed below the needle plate, a horizontal hook mechanism is provided. When the horizontal hook mechanism needs to be accessed, for instance, to remove thread caught up in the horizontal hook mechanism or to clean the horizontal hook mechanism and its surroundings for maintenance purposes, the needle plate is removed by loosening the screw to expose the horizontal hook mechanism and its surroundings. When reattaching the needle plate to the bed, the needle plate needs to be carefully located with the sewing needle and the feed dog. Mislocation of the needle plate may cause unwanted contact with the sewing needle and the feed dog, possibly leading to mechanical damages.

To address such concerns, a needle plate was conceived that comprises a first needle plate provided with a needle hole and angular holes, and a second needle plate situated above the horizontal hook mechanism. This type of needle plate is provided with an engagement mechanism for establishing engagement between the first needle plate and the second needle plate, and a disengagement button that cancels the engagement of the engagement mechanism through user operation performed from the top side of the needle plate. The engagement mechanism is provided with a protrusion that is formed at the first needle plate and a slot being defined on a leaf spring provided at the second needle plate, which are mated to establish the engagement. The engagement is cancelled by depressing the disengagement button. Thus, second needle plate alone can be removed from the bed with the first needle plate staying secured on the bed.

The above described configuration, however, requires a two-step operation to remove the second needle plate. More specifically, the two-step operation includes a first operation in which the disengagement button is depressed against the elasticity of the leaf spring and a second operation in which the second needle plate is pulled away from the first needle plate while the disengagement button is depressed. However, not only is the two-step operation cumbersome but is also hard to carry out because the first operation is performed in one direction and the second operation is performed in another.

SUMMARY

One object of the present disclosure is to provide a needle plate that allows reliable attachment of the second needle plate to the first needle plate and that simplifies the attachment/detachment of the second needle plate to/from the first needle plate as much as possible. It is another object of the present disclosure to provide a sewing machine provided with such needle plate.

In one aspect, the present disclosure discloses a needle plate for placement on an upper surface of a sewing machine bed containing a horizontal hook mechanism, the needle plate including a first needle plate that is secured on the sewing machine bed and that includes a needle hole allowing penetration of a sewing needle and an angular hole allowing protruding and retracting of a feed dog that feeds a workpiece cloth; a second needle plate that is disposed adjacent to the first needle plate and above the horizontal hook mechanism, the second needle plate being detachably attached to the first needle plate; an engagement mechanism that includes an engagement member formed at the first needle plate and an engagement subject member formed at the second needle plate, wherein the second needle plate is retained with the first needle plate through engagement of the engagement member and the engagement subject member; and a switching element that allows switching in positioning of the second needle plate relative to the first needle plate between the first position and the second position, the second needle plate, when in the first position, being secured in intimate contact with the first needle plate with the engagement mechanism in an engaged state, and the second needle plate, when in the second position, being distanced from the first needle plate with the engagement mechanism in a disengaged state.

In another aspect, the present disclosure discloses A sewing machine includes a sewing machine bed that contains a horizontal hook mechanism; and a needle plate placed on an upper surface of the sewing machine bed, the needle plate including: a first needle plate that is secured on the sewing machine bed and that includes a needle hole allowing penetration of a sewing needle and an angular hole allowing protruding and retracting of a feed dog that feeds a workpiece cloth; a second needle plate that is disposed adjacent to the first needle plate and above the horizontal hook mechanism, the second needle plate being detachably attached to the first needle plate; an engagement mechanism that includes an engagement member formed at the first needle plate and an engagement subject member formed at the second needle plate, wherein the second needle plate is retained with the first needle plate through engagement of the engagement member and the engagement subject member; and a switching element that allows switching in positioning of the second needle plate relative to the first needle plate between the first position and the second position, the second needle plate, when in the first position, being secured in intimate contact with the first needle plate with the engagement mechanism in an engaged state, and the second needle plate, when in the second position, being distanced from the first needle plate with the engagement mechanism in a disengaged state.

Other objects, features and advantages of the present disclosure will become clear upon reviewing the following description of the illustrative aspects with reference to the accompanying drawings.

DETAILED DESCRIPTION

A first exemplary embodiment of the present disclosure will be described with reference to FIGS. 1 to 10B through an example of a household sewing machine M provided with first needle plate and second needle plate.

Figure 1:
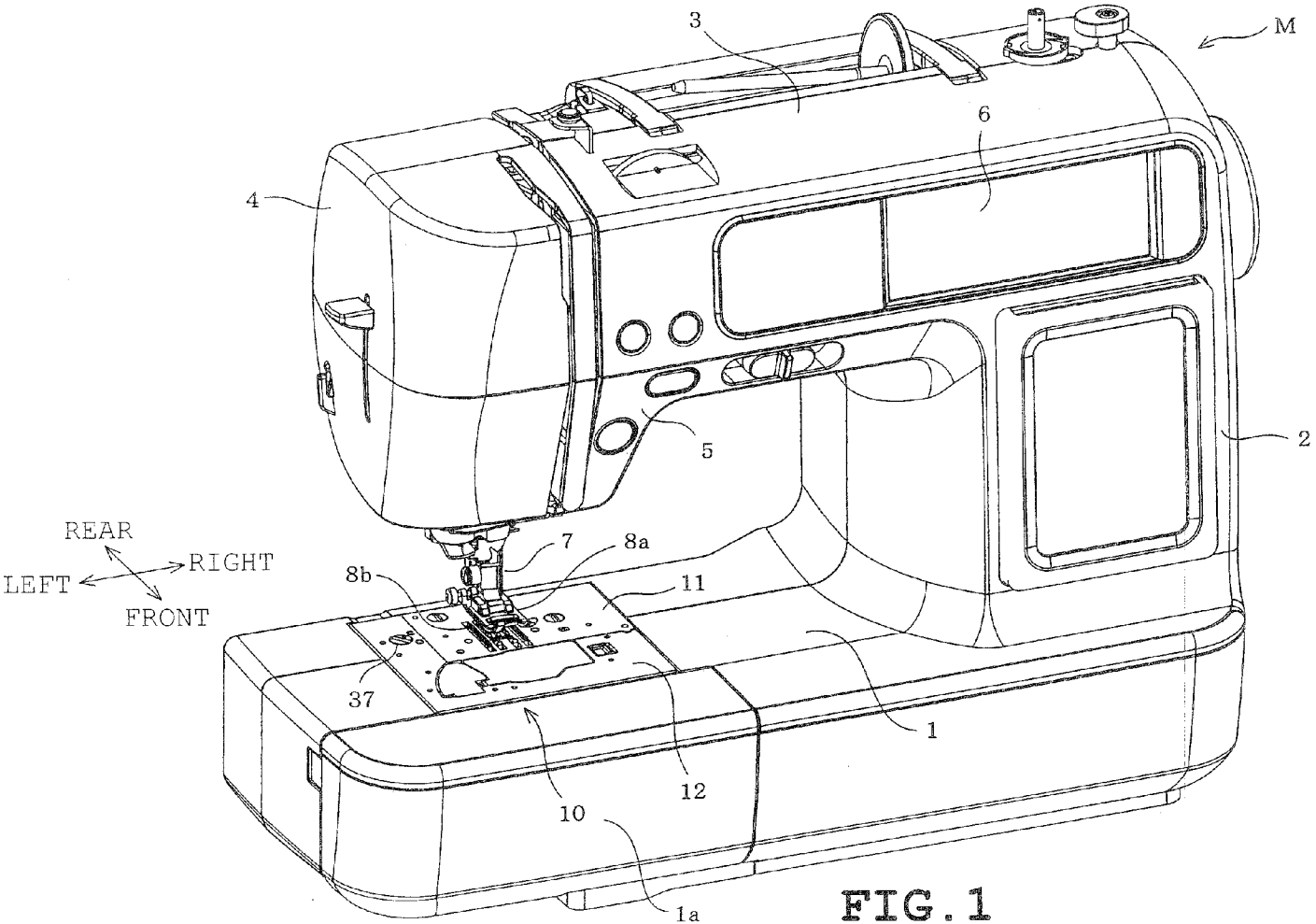
FIG. 1 is a general perspective view of a sewing in which a second needle plate is attached to a first needle plate according to a first exemplary embodiment of the present disclosure.

As typically shown in FIG. 1, sewing machine M includes components such as bed 1, pillar 2, arm 3 and head 4. Pillar 2 extends upward from the right end of bed 1 and has arm 3 which extends leftward over bed 1 from its upper end and which terminates into head 4. Bed 1, pillar 2, arm 3, and head 4 are thus, structurally integral. Throughout the description given herein, the direction in which the user, or the operator, of sewing machine M positions himself/herself facing the laterally extending arm 3 of sewing machine M is defined as the forward direction/front side. For instance, in FIG. 1, the direction normal to the page indicates the front and rear direction whereas the direction in which arm 3 extends orthogonal to the front and rear direction indicates the left and right direction.

On the front face of arm 3, various switches 5 are provided whereas on the front face of pillar 2, a wide liquid crystal display 6 hereinafter also referred to as LCD 6 is provided.

Arm 3 contains a sewing machine main shaft not shown that extends in the left and right direction as well as a sewing machine motor not shown that rotates the sewing machine main shaft. Though not shown in detail, head 4 contains a needle bar that has sewing needle 7 attached to its lower end. Near sewing needle 7, presser foot 8*a* is provided for depressing workpiece cloth not shown. Though not shown, arm 3 further contains components such as a needle-bar drive mechanism, a needle-bar swing mechanism, and thread take-up mechanism. The needle-bar drive mechanism drives the needle bar up and down based on the rotation of the sewing machine main shaft. The needle bar swing mechanism swings the needle bar in the left and right direction orthogonal to the direction in which the workpiece cloth is fed. The thread take-up mechanism drives a thread take-up not shown up and down in synchronism with the up and down movement of the needle bar.

On the upper surface of bed 1, needle plate 10 is provided. Though not shown in detail, within bed 1 below needle plate 10, a feed mechanism is provided that moves feed dog 8*b* shown in FIG. 2 up and down and back and forth. As further shown in FIG. 2, below needle plate 10 and more precisely below a later described second needle plate 12, horizontal hook mechanism 9 is provided. Horizontal hook mechanism 9 houses a bobbin not shown and forms stitches in coordination with sewing needle 7.

Next, needle plate 10 will be discussed with reference to FIGS. 3 to 6.

As shown in FIGS. 3 to 6, needle plate 10 is generally rectangular and comprises first needle plate 11 fixed to bed 1, and second needle plate 12 detachably attached to first needle plate 11. Detachably attached in this context means that second needle plate 12 is attached to first needle plate 11 such that it can be repeatedly detached from and attached (reattached) to first needle plate 11.

Figure 2:
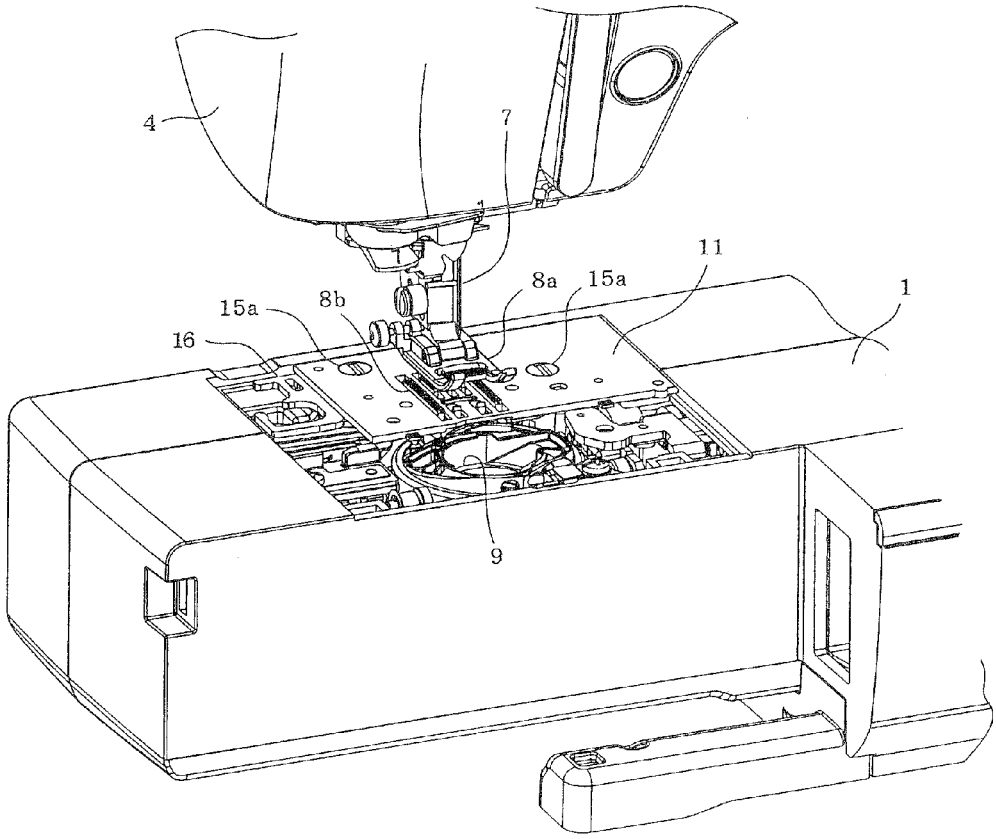
FIG. 2 is a perspective view of the sewing machine with an auxiliary table and the second needle plate removed from a sewing machine bed.

First needle plate 11 is made of a metal material and is generally rectangular. First needle plate 11 is provided with needle hole 13 that allows penetration of sewing needle 7, and a plurality of angular holes 14 through which feed dog 8*b* protrudes or retracts to feed the workpiece cloth. The first exemplary embodiment exemplifies 7 angular holes 14. Needle hole 13 is formed as a laterally elongate curve, whereas each of angular holes 14 is formed as a thin straight line running in the front and rear direction so as to collectively encompass needle hole 13. First needle plate 11 is further provided with a couple of through holes 15 through which screws 15*a* shown in FIG. 2 is threaded to fasten itself to the upper surface of bed 1.

Figure 4:
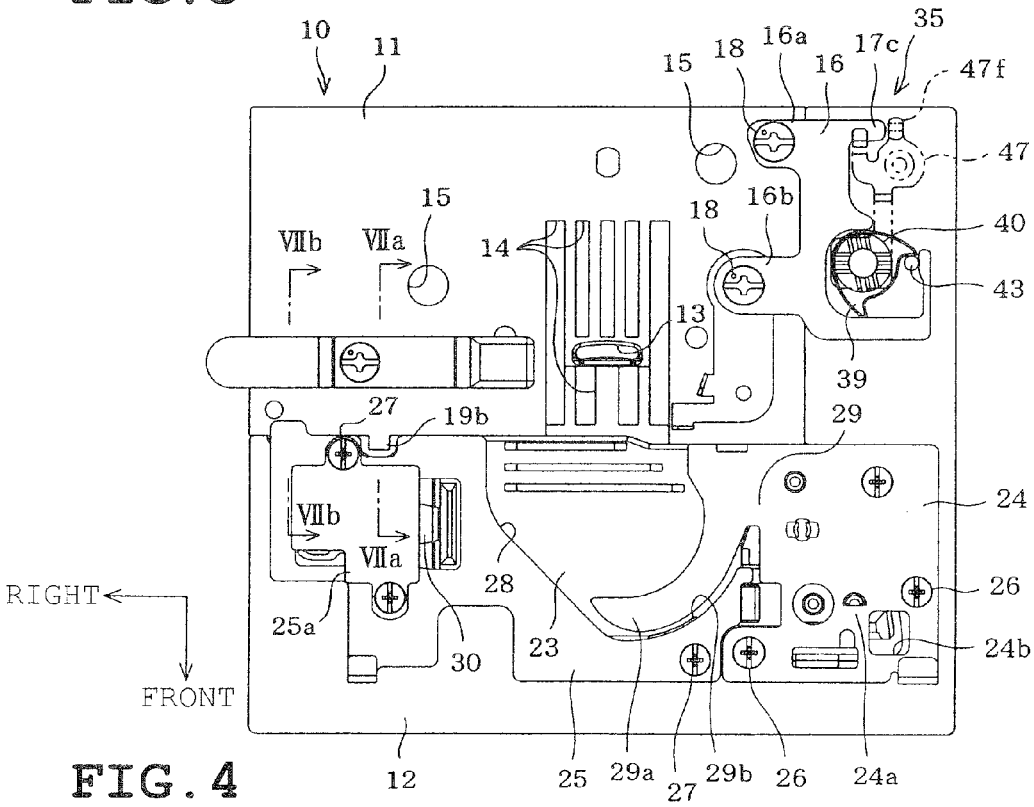
FIG. 4 is a bottom view of the first and the second needle plates with the switching element switched to the first position.
Figure 6:
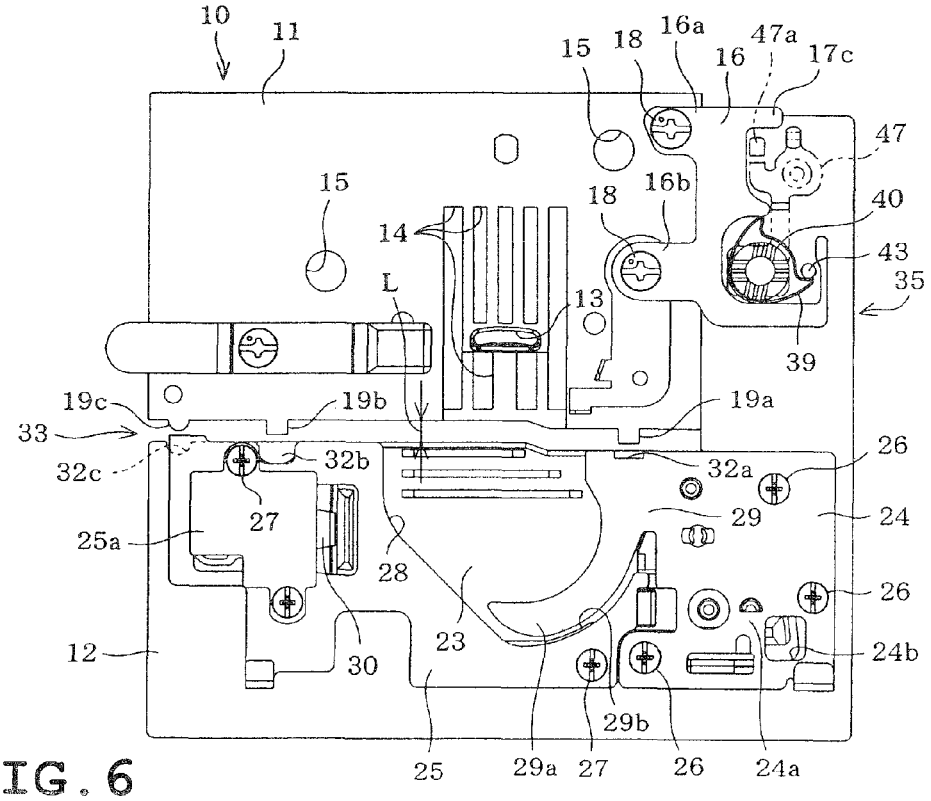
FIG. 6 is a bottom view of the first and the second needle plates with the switching element switched to the second position.
Figure 10A:
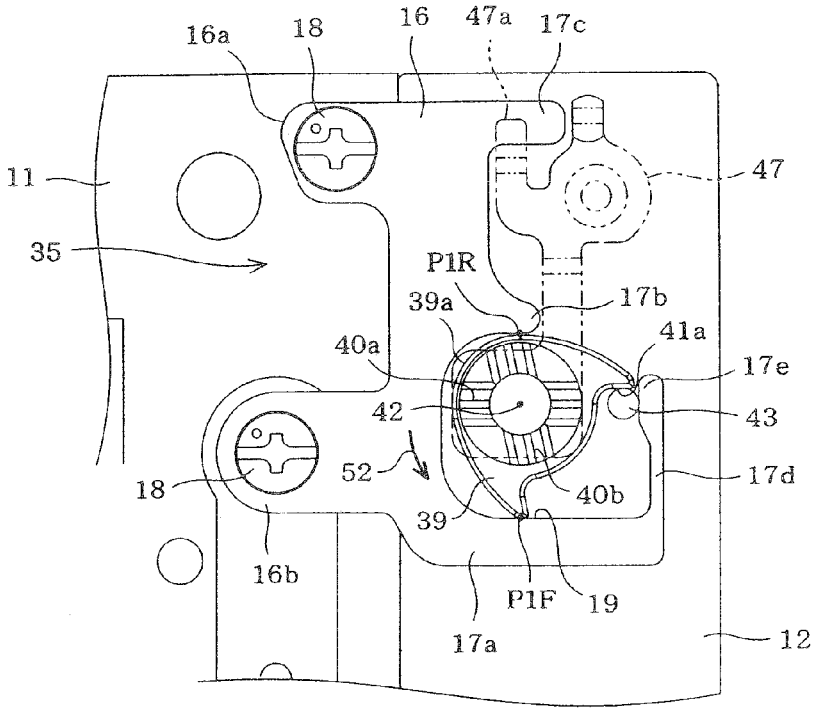
FIGS. 10A and 10B are enlarged bottom view of the switching element being switched to the first position and the second position.

FIGS. 4 and 6 show the underside of first needle plate 11. At the rearward right corner of first needle plate 11 underside as viewed in FIGS. 4 and 6 (corresponding to the rearward left corner in top view), contact member 16 is provided. Contact member 16 is made of metal and is generally J-shaped. On the forward portion and the reward portion of contact member 16, attachments 16*a* and 16*b* extend toward first needle plate 11. Attachments 16*a* and 16*b* are structurally integral with contact member 16. Screws 18 are fastened through attachments 16*a* and 16*b* to secure contact member 16 to first needle plate 11. As shown in FIG. 10A, contact member 16 is further integrally provided with 3 contact sections 17*a* to 17*c* that extend leftward toward second needle plate 12 in the opposite direction from the direction of extension of attachments 16*a* and 16*b*. In more detail, forward contact section 17*a* and mid contact section 17*b* located at the forward and middle portions of contact member 16 surround a later described activation cam 39. The surface running between contact section 17*a* and contact section 17*b* of contact member 16 define sliding contact surface 19 capable of contacting the outer periphery of activation cam 39.

At the end of forward contact section 17*a* of contact member 16, a narrow guide piece 17*b* is formed that extends longitudinally.

Figure 9A:
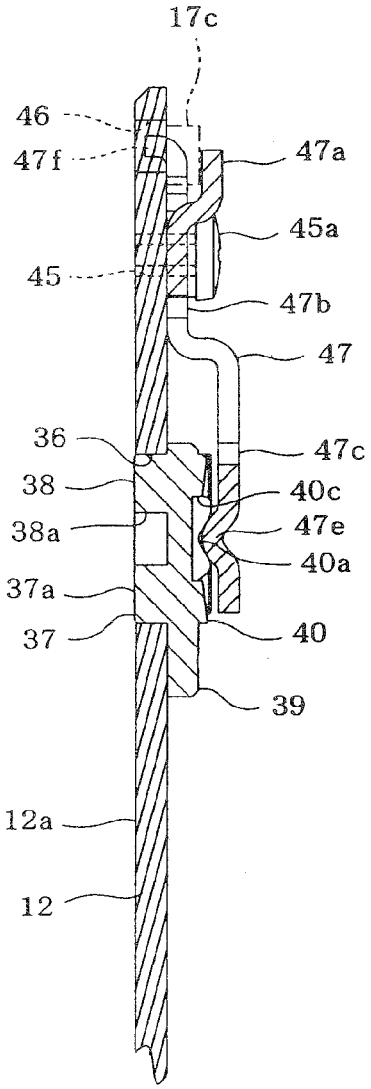
FIG. 9A is a cross sectional view taken along line IXa-IXa of FIG. 9B.
Figure 9B:
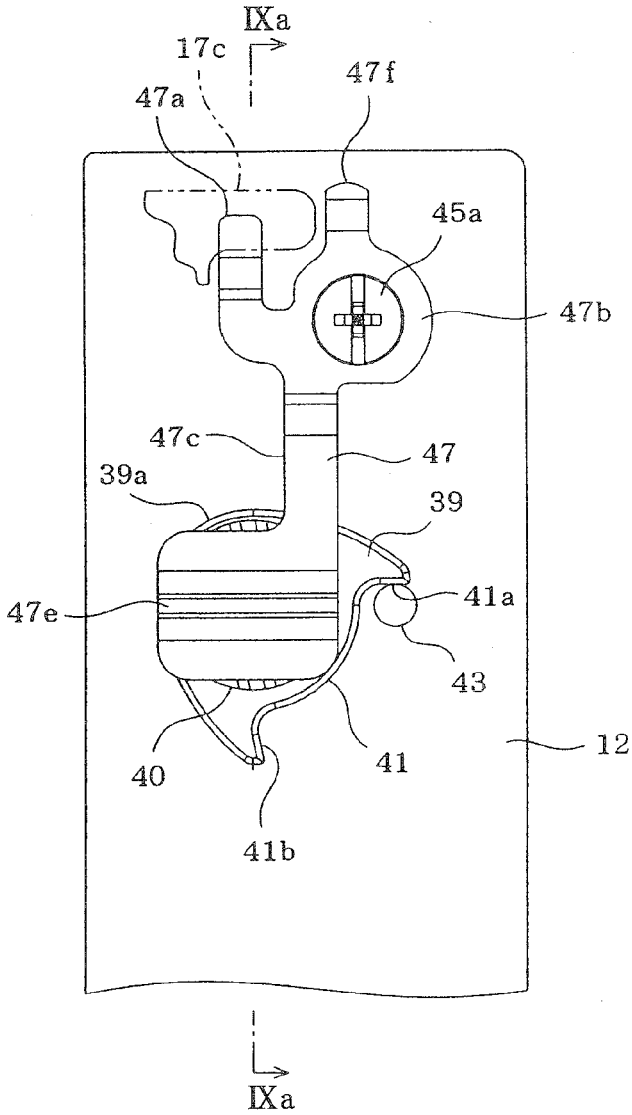
FIG. 9B is an enlarged bottom view of the proximity of the switching element at the second needle plate.

The free end at the extremity of guide piece 17*d* is formed into guide head 17*e* that, when engaged with a later described emboss 43, places second needle plate 12 in intimate contact with first needle plate 11. Guide piece 17*d*, being bendable, acts like a spring member to urge second needle plate 12 in a gapless intimate contact with first needle plate 11 by way of emboss 43. Rearward contact section 17*c* located at the reward portion of contact member 16 is clamped between the underside of second needle plate 12 located above it and a later described clamp section 47*a* of retaining member 47 located below it as can be seen in FIGS. 9A and 9B.

Figure 5:
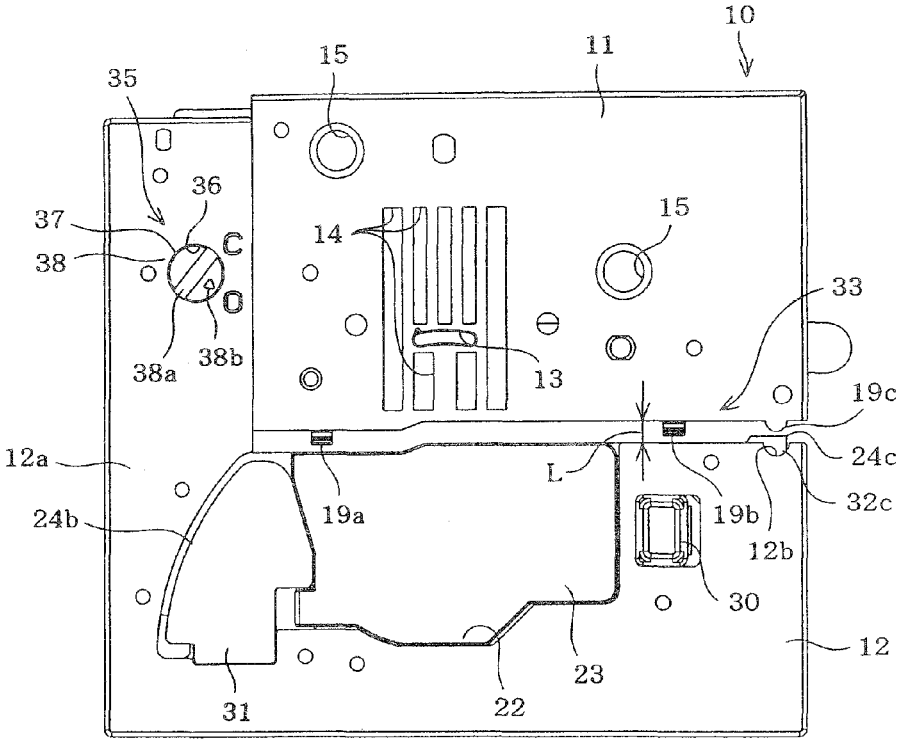
FIG. 5 is a top view of the first and the second needle plates with the switching element switched to a second position.
Figure 7A:
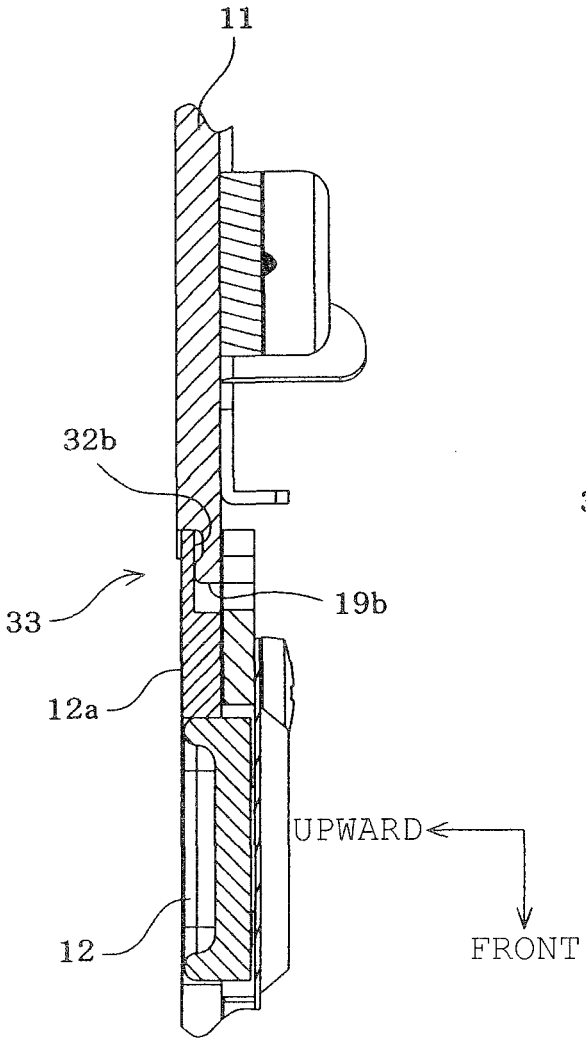
FIGS. 7A and 7B are cross sectional views of an engagement mechanism taken along lines VIIa-VIIa and VIIb-VIIb of FIG. 4.

Referring now to FIGS. 5 and 6, the front edge of first needle plate 11 is provided with a plurality of forwardly protruding engagement tongues 19*a* to 19*c* that are laterally spaced apart. The first exemplary embodiment exemplifies 3 engagement tongues 19*a* to 19*c*. Among engagement tongues 19*a* to 19*c*, the rightmost engagement tongue 19*c* is semicircular in plan view and is configured to be as thick as first needle plate 11. Remaining other engagement tongues 19*a* and 19*b* are rectangular in plan view. Engagement tongues 19*a* and 19*b* are configured to be half as thick as first needle plate 11 as shown in FIG. 7A and are formed so as to be continuous with the underside of first needle plate 11.

Figure 3:
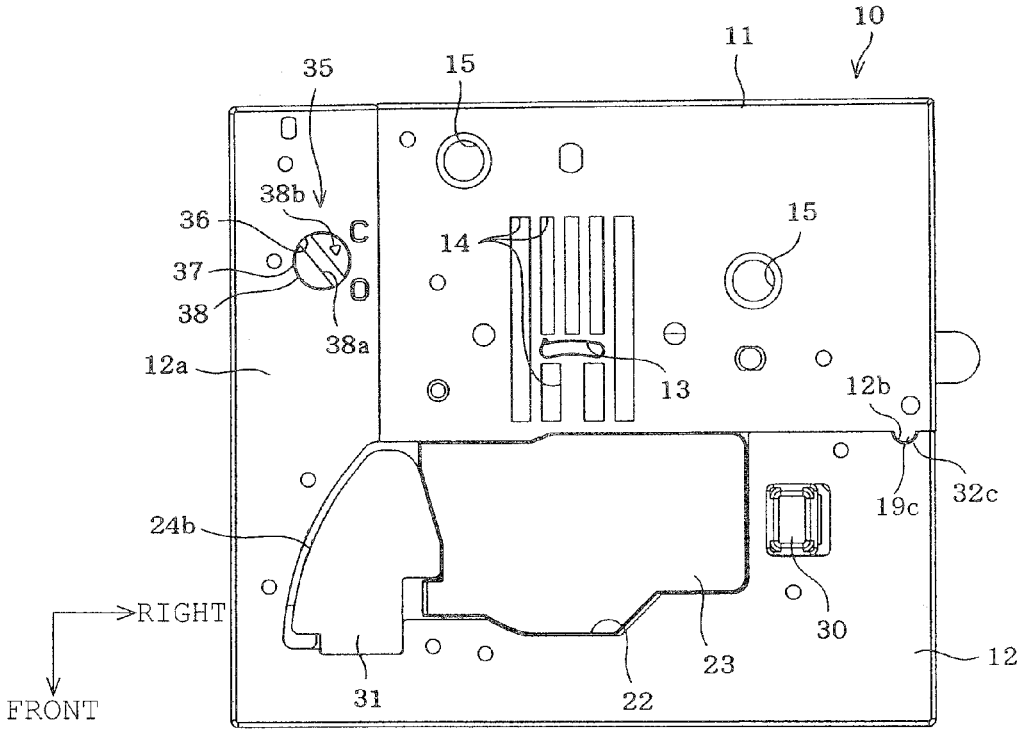
FIG. 3 is a top view of the first and the second needle plates with a switching element switched to a first position.

Second needle plate 12, on the other hand, may be made of metal plate and is configured in L-shape in plan view that extends along the front and the left edges of first needle plate 11. As can be seen in FIG. 3, second needle plate 12 is provided with opening 22 which opens up rearward in plan view at its lateral mid section. Opening 22 provides access for taking the bobbin in and out of horizontal hook mechanism 9. Opening 22 is covered by a transparent needle plate cover 23 made of synthetic resin which is detachably attached over second needle plate 12.

Referring now to FIG. 4, a pair of left and right guide plates identified as first bobbin thread guide plate 24 and second bobbin thread guide plate 25 are secured against the underside of second needle plate 12 by screws 26 and 27. These guide plates 24 and 25 define bobbin slot 28 which follows opening 22. The peripheral edge of bobbin slot 28 of guide plates 24 and 25 are caved downward as much as the thickness of needle plate cover 23 and serves as bottom wall 29 which is stepped down from upper surface 12*a* of second needle plate 12. A part of bottom wall 29 located in first bobbin thread guide plate 24 side forms a generally crescent thread guide 29*a* that guides the bobbin thread drawn from the bobbin leftward. Bottom wall 29 is further provided with an arch shaped first guide groove 29*b* communicating with bobbin slot 28 and being located in front of bobbin thread guide 29*a*.

Second bobbin thread guide plate 25 is provided with retaining member attachment 25*a* at the right side of needle plate cover 23. Retaining member attachment 25*a* allows attachment of elastic retaining member 30 that presses needle plate cover 23 leftward. The elasticity of retaining member 30 unremovably locks needle plate 23 in place. When retaining member 30 is urged rightward away from needle plate cover 23 against the elasticity, removal of needle plate cover 23 is permitted. Removal of needle plate cover 23 from opening 22 through the operation of retaining member 30 permits access through opening 22 and bobbin slot 28 for installing bobbin into horizontal hook mechanism 9.

First bobbin thread guide plate 24 is provided with cover attachment 24*a* on the left side of needle plate cover 23. Cover attachment 24*a* allows attachment of cover 31 made of synthetic resin as shown in FIG. 3. Cover attachment 24*a* is provided with second guide groove 24*b* that defines a gap along the peripheral edge of cover 31 and that communicates with the left end of first guide groove 29*b* below cover 31. At the lower edge of cover 31, a blade not shown is provided for cutting the bobbin thread at the forward extreme of second guide groove 24*b*.

Figure 7B:
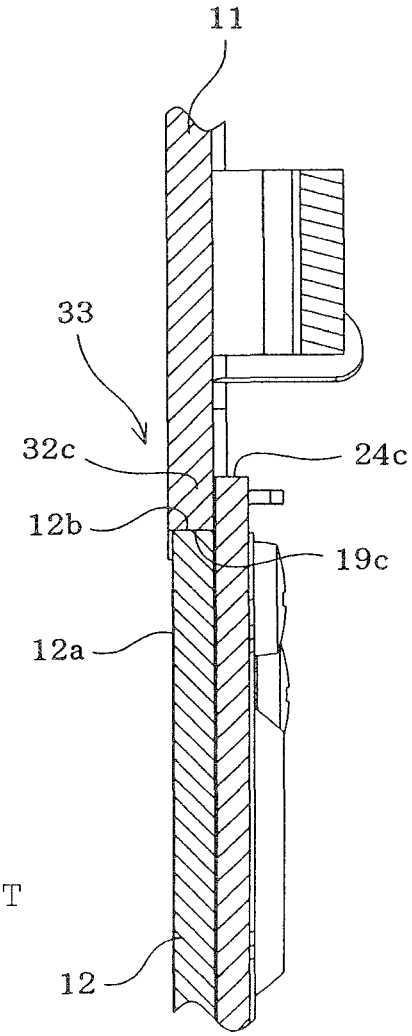

Referring now to FIG. 6, on the rear edge of second needle plate 12 opposing the front edge of first needle plate 11, engagement catches 32*a* to 32*c* capable of engaging with aforementioned engagement tongues 19*a* to 19*c* of first needle plate 11 are provided. Among engagement catches 32*a* to 32*c*, the rightmost engagement catch 32*c* is composed of a semicircular notch 12*b* shown in FIG. 5 defined on second needle plate 12 and protrusion 24*c* formed so as to face engagement tongue 19*c*. Referring to FIGS. 3 and 7B, engagement catch 32*c* establishes a fitting engagement with engagement tongue 19*c* such that notch 12*b* is fitted with engagement tongue 19*c* and protrusion 24*c* provides bottom support to engagement tongue 19*c*. Remaining other engagement catches 32*a* and 32*b*, in contrast, establish engagement with engagement tongues 19*a* and 19*b* such that engagement tongues 19*a* and 19*b* provide bottom support to engagement catches 32*a* and 32*b*. As detailed, for instance, in FIG. 7A, engagement catch 32*b* is defined such that the portion of the underside of second needle plate 12 mating with engagement tongue 19*b* is notched.

Thus, engagement established between engagement tongues 19*a* to 19*c* and engagement catches 32*a* to 32*c* determines the longitudinal and lateral positioning of second needle plate 12 relative to first needle plate 11 as well as maintaining the structural integrity of needle plate 10 as a whole. Engagement tongues 19*a* to 19*c*, engagement catches 32*a* to 32*c*, rear contact section 17*c*, and clamp section 47*a* constitute engagement mechanism 33 of the first exemplary embodiment.

Needle plate 10 is further provided with switching element 35 that switches the engagement status of engagement mechanism 33 between the engaged state in which the second needle plate 12 is placed in intimate contact with first needle plate 11 and the disengaged state in which second needle plate 12 is separated away from first needle plate 11. The structure and the working of switching element 35 will be described with reference to FIGS. 8 to 10B.

Figure 8:
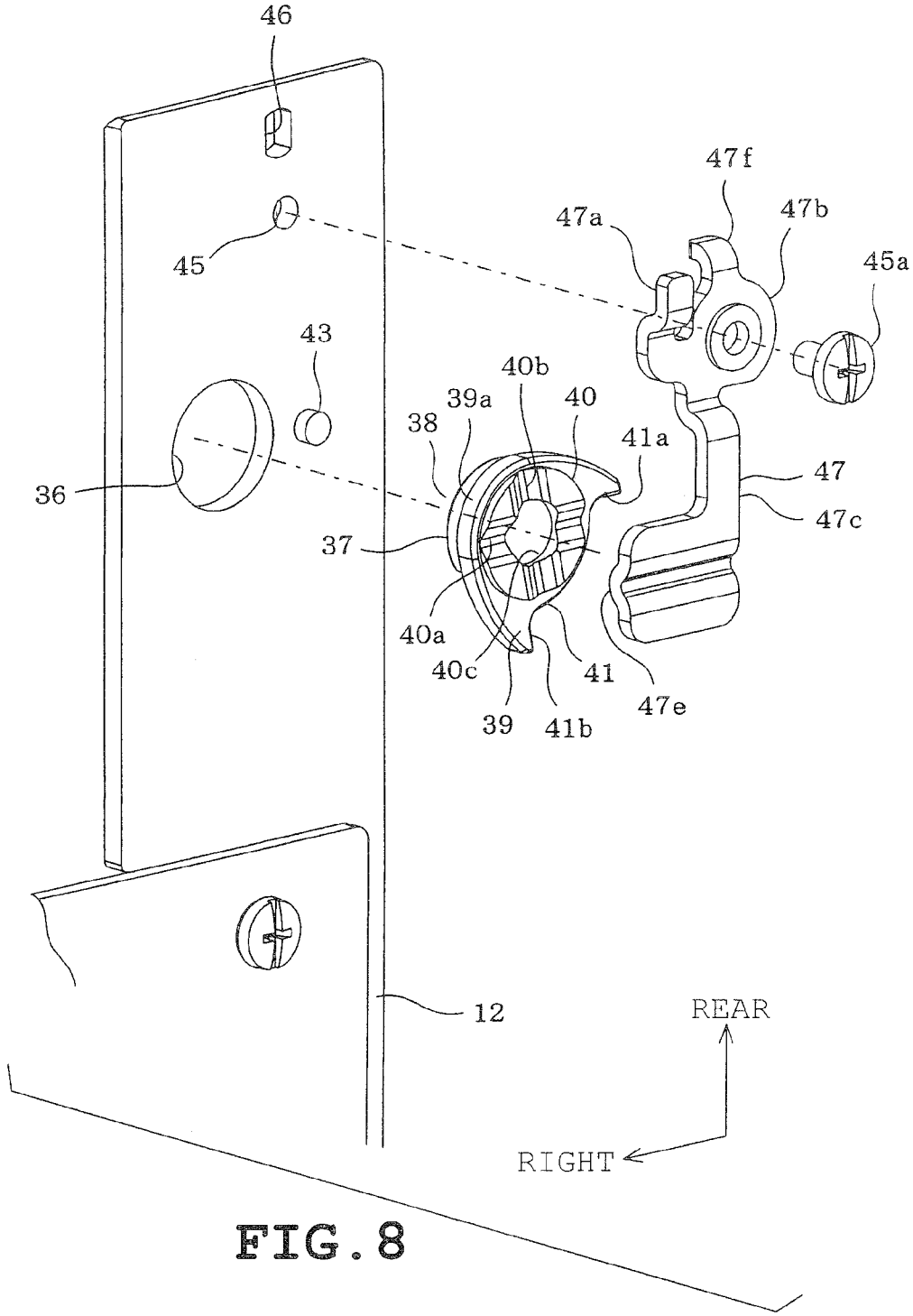
FIG. 8 is an enlarged exploded perspective view of the switching element situated at the second needle plate.

As can be typically seen in FIGS. 3, 8, and 9A, second needle plate 12 has a round through hole identified as attachment hole 36 defined on its rear portion. Attachment hole 36 has operable member 37 of switching element 35 rotatably attached to it. In more detail, operable member 37 is primarily configured by disc 38 that is rotatably fitted into attachment hole 36. As can be seen in FIG. 9A, disc 38 is configured to be as thick as second needle plate 12. Below disc 38, activation cam 39 is provided which has retaining subject 40 defined on its underside as can be seen in the exploded view of FIG. 8. Disc 38, activation cam 39, and retaining subject 40 are made of synthetic resin material and are injection molded into an integral structure. Because of such integral structure, operable member 37, disc 38, and activation cam 39 may be collectively referred to as operable member 37 in the following descriptions of the first exemplary embodiment.

Referring to FIG. 3, disc 38 has recess 38*a* extending diametrically across its upper surface in the form of a slit. Provided further on the upper surface of disc 38 is indicator 38*b* situated at the proximity of the circumferential edge that indicates the switching status as will be described in detail hereinafter. Operable member 37 may be readily operated by inserting the tip of a tool not shown into recess 38*a* and turning the tool. The shape of recess 38*a* may be modified depending upon the tool being used to turn operable member 37. For instance, recess 38*a* may be configured as a straight groove or cruciform groove for accepting a minus or a plus screw driver; or as a polygonal recess such as a hexagonal recess to accept a hexagonal wrench.

As can be seen in FIGS. 3 and 5, characters "C" and "O" are engraved on the upper surface of second needle plate 12. "C" stands for CLOSE whereas "O" stands for OPEN. When operable member 37 is in the first position, indicator 38*b* points to "C" as can be in FIG. 3. When operable member 37 is in the second position, indicator 38*b* points to "O" as can be in FIG. 5.

As can be typically seen in FIGS. 8 and 10A, activation cam 39 comprises a triangular cam which is one type of a positive cam and has one of its three sides deformed by, for instance, notching.

A triangular cam in this context has a perimeter obtained by linking the circumferences of 3 circles each being centered on a vertex of a given triangle. The circles centered on the two opposing vertexes differ in their measurement of radii. The triangular cam is configured to rotate about one of the three vertexes of the triangle. The perimeter of the triangular cam can be obtained by adding the radii of the circles. The cam follower being moved by the rotation of the triangular cam normally contacts the triangular cam at least from two sides. Thus, the triangular cam rotates smoothly to allow the designed movement of the cam follower.

According to the first exemplary embodiment, as typically shown in FIGS. 8, 9A, and 10, the perimeter of activation cam 39 is configured to be greater than that of disc 38. Further, one of the three sides of the triangular cam is deformed by notching to define rotation regulator 41. Activation cam 39 contacts the underside of second needle plate 12 with disc 38 being fitted into attachment hole 36. As described earlier, disc 38 is configured to be as thick as second needle plate 12 and thus, upper surface 37*a* of operable member 37 and upper surface 12*a* of second needle plate 12 are flush as can be seen in FIG. 9A.

From the underside of second needle plate 12, emboss 43 protrudes downward in the proximity of attachment hole 36. In the first exemplary embodiment, emboss 43 is configured to be structurally integral with the underside of second needle plate 12. Emboss 43 limits the range of rotational movement of activation cam 39 to the first position shown in FIG. 10A and the second position shown in FIG. 10B through physical contact with activation cam 39. More specifically, rotation of activation cam 39 in the direction of arrow 51 is limited by contact between one end of rotation regulator 41 and emboss 43. Rotation of activation cam 39 in the direction of arrow 52 is limited by contact between the other end of rotation regulator 41 and emboss 43. Further, as activation cam 39 rotates, activation cam 39 changes its position of contact with sliding contact surface 19 of contacting member 16. This variation in the position of contact causes the movement of second needle plate 12 relative to contact member 16 and consequently first needle plate 11, meaning that contact member 16 provided with sliding contact surface 19 serves as a cam follower and constitutes cam mechanism 44 along with activation cam 39. Because activation cam 39 is configured as a triangular cam, no rattling is observed between activation cam 39 and contact member 16 at least in the longitudinal direction, i.e., the up and down direction as viewed in FIG. 10A when activation cam 39 is in rotation.

Figure 10B:
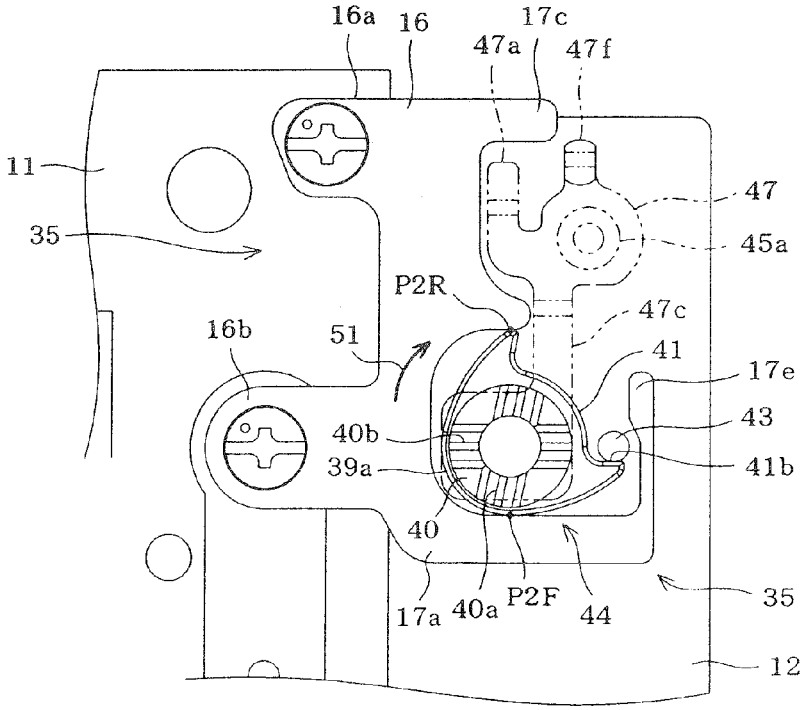

Retaining subject 40 is disc shaped and formed on the underside of activation cam 39. As shown in FIGS. 8 and 9A, the underside of retaining subject 40 has a central recess 40*c* and a pair of grooves 40*a* and 40*b* crossing over at central recess 40*c*. Both grooves 40*a* and 40*b* have a V-shape cross section. When operable member 37 is in the first position, groove 40*a* is oriented laterally as shown in FIG. 10A, whereas when operable member 37 is in the second position, groove 40*b* is oriented laterally as shown in FIG. 10B.

Referring now to FIG. 8, second needle plate 12 is provided with female thread 45 and lock slot 46 located reward relative to attachment hole 36. Screw 45*a* is fastened into female thread 45 to secure retaining member 47 on the underside of second needle plate 12. Retaining member 47 is made of metal spring material possessing elasticity for example and is in an elongate form extending from the rear end portion of second needle plate 12 to retaining subject member 40. Retaining member 47 is provided with an annular attachment 47*b* allowing insertion of screw 45*a* and arm 47*c* that extends toward retaining subject 40 from attachment 47*b*. The free end at the tip of arm 47*c* is laterally wider as compared to the other components of retaining member 47. On the tip of arm 47*c*, a laterally extending ridge 47*e* is formed by bending the tip. Ridge 47*e* establishes a selective fitting engagement with groove 40*a* or 40*b* of retaining subject 40. The fitting of groove 40*a* or 40*b* with ridge 47*e* is perceived e.g. as a clicking which is an indication that secure engagement has been established to maintain retaining subject 40 and consequently operable member 37 in the first or the second position. Though not shown in detail, the free end of arm 47*c* is elastically deformed downward by the elasticity of the spring material to the extent to allow ridge 47*e* to be disengaged from grooves 40*a* and 40*b*.

Retaining member 47 has, at the rear end of attachment 47*b*, lock member 47*f* bending upward in L-shape. Lock member 47*f* is engaged with lock slot 46 to prohibit turning of retaining member 47. Operable member 37, when rotated, exerts force on retaining member 47 in the direction of rotation. Though retaining member 47 is fastened by screw 45*a*, it is repeatedly subjected to the rotational force. Thus, screw 45*a* may loosen over time to cause the rotation of retaining member 47 and consequently displacing it from its original position. Lock member 47*f* eliminates such disadvantage by preventing rotational displacement of retaining member 47 through its secure locking. Retaining member 47 is further provided with clamp section 47*a* which is bent downward like a crank and which is located on the right side portion of attachment section 47*b*. When second needle plate 12 is attached to first needle plate 11, rear contact section 17*c* of contact member 16 is clamped between the underside of second needle plate 12 located above it and clamp section 47*a* located below second needle plate 12 as shown in FIG. 10A. The above described components such as disc 38, activation cam 39, contact member 16, and retaining subject 47 constitute switching element 35.

FIG. 8 shows how switching element 35 is assembled in second needle plate 12. First, disc 38 of operable member 37 is inserted into attachment hole 36 from the underside of second needle plate 12. Then, retaining member 47 is secured on second needle plate 12 with screw 45*a*. Thus, operable member 37 is allowed to rotate relative to second needle plate 12 while being held from below by arm 47*c* of retaining member 47 such that it does not come off of attachment hole 36.

Next, a description will be given on the working of the above described needle plate 10.

As shown in FIGS. 5 and 6, when operable member 37 is placed in the second position in which indicator 38*b* points to the "O (OPEN)" label, second needle plate 12 is distanced by a predetermined distance L away towards the front side of the stationary first needle plate 11 in which state, second needle plate 12 is not attached to first needle plate 11. The second position of operable member 37 is retained by the fitting engagement between groove 40*b* and protrusion 47*e* of retaining member 47 as can be seen in FIG. 10B. Further, when operable member 37 is placed in the second position, engagement mechanism 33 is placed in the disengaged state in which engagement tongues 19*a* to 19*c* and engagement catches 32*a* to 32*c* are disengaged and rear contact portion 17*c* and clamp section 47*a* are disengaged as well. Thus, the operator may readily remove second needle plate 12 from the first needle plate 11.

By switching operable member 37 from the second position to the first position, the operator is allowed to attach second needle plate 12 to first needle plate 11 from the unattached state. To elaborate on the switching, the operator may insert the tip of a tool not shown such as a screw driver into recess 38*a* of operable member 37 and turn operable member 37 from the second position to the first position. This switching causes activation cam 39 to turn in the direction of arrow 51 indicated in FIG. 10B while sliding in contact with sliding contact surface 19 of contact member 16. Thus, the point of contact or contact position of activation cam 39 on sliding contact surface 19 is moved from points P2F and P2R shown in FIG. 10B to points P1F and P1R shown in FIG. 10A, respectively. The variation in the contact position of that is, the variation in the distance between the contact location and rotation center 42 of operable member 37 gives the longitudinal linear displacement of contact member 16 and consequently first needle plate 11 relative to activation cam 39 provided on second needle plate 12. That is, second needle plate 12 is moved rearward relative to first needle plate 11 and is urged leftward as viewed in FIG. 10A by emboss 43 and guide projection 17*e* of contact member 16 to be placed in intimate contact with first needle plate 11.

As operable member 37 is switched to the first position, groove 40*a* travels to the first position and is placed in fitting engagement, which may be perceived as a clicking, with ridge 47*e* of retaining member 47 to lock operable member 37 at the first position. Under such state, activation cam 39 and contact member 16 are placed in contact at point P1F and point P1R to unmovably lock second needle plate 12 in attachment with first needle plate 11. Further, engagement tongues 19*a* to 19*c* and engagement catches 32*a* to 32*c* establish a longitudinal fitting engagement as can be seen in FIGS. 7A and 7B. Further, rear contact portion 17*c* of contact member 16 is clamp engaged between the underside of second needle plate 12 and clamp section 47*a* of retaining member 47 to laterally and longitudinally locate second needle plate 12 relative to first needle plate 11.

Second needle plate 12 shown in FIGS. 3, 4, and 10A maintain the attachment to first needle plate 11 through the lock established between the above described contact of activation cam 39 and contact member 16 as well as through the engagement rendered by engagement mechanism 33. In this state, operable member 37 is switched to the first position in which indicator 38*b* points to "C (Close)" label on the upper surface of second needle plate 12.

At this instance, point P1F, point P1R, and rotation center are substantially collinear, and the imaginary line interconnecting the foregoing is oriented in the front and rear direction. Thus, even when forward external force is exerted on second needle plate 12 from the rear side of the second needle plate 12 being attached to first needle plate 11, no momentum is exerted in the direction to turn activation cam 39. Thus, even if second needle plate 12 is subjected to such external force, the second needle plate 12 will not be detached from first needle plate 1.

Detachment of second needle plate 12 from first needle plate 11 can be done by merely switching operable member 37 from the first position to the second position. That is, as described earlier, the tip of the tool is inserted into recess 38*a* of operable member 37 to turn operable member 37 from the first position to the second position. The switching operation causes activation cam 39 to be turned in the direction of arrow 52 indicated in FIG. 10A while sliding in contact with surface 19 of contact member 16. Thus, the point of contact or contact position of activation cam 39 on sliding contact surface 19 is moved from points P1F and P1R shown in FIG. 10A to points P2F and P2R shown in FIG. 10B, respectively. The variation in the contact position, that is, the variation in the distance between the contact location and rotation center 42 of operable member 37 gives the longitudinal linear displacement of contact member 16 and consequently first needle plate 11 relative to activation cam 39 provided on second needle plate 12. That is, second needle plate 12 is moved forward relative to first needle plate 11.

As operable member 37 is switched to the second position, groove 40*a* travels to and is placed in fitting engagement, which may be perceived as a clicking, with ridge 47*e* of retaining member 47 to lock operable member 37 at the second position. Under such state, activation cam 39 and contact member 16 are placed in contact at point P2F and point P2R to move second needle plate 12 away from first needle plate 11 by distance L. Further, the engagement between engagement tongues 19*a* to 19*c* and engagement catches 32*a* to 32*c* and between rear contact portion 17*c* and clamp section 47*a* are cancelled. Thus, the operator may readily remove second needle plate 12 from first needle plate 11.

Distance L taken in the front and rear direction by second needle plate 12 away from first needle plate 11 relies on the configuration of cam mechanism 44. More specifically, distance L is determined by the difference in the distance between contact point P1F and rotation center 42 and the distance between contact point P2F and rotation center 42. Thus, distance L can be controlled to a given distance through modification of design such as the shape of activation cam 39.

As described above, needle plate 10 according to the first exemplary embodiment is provided with switching element 35 that switches second needle plate 12 between the first position in which second needle plate 12 is locked in intimate contact with first needle plate 11 with engagement mechanism 33 in the engaged state, and the second position in which second needle plate 12 is moved away from first needle plate 11 with engagement mechanism 33 in the disengaged state.

According to the above described configuration, second needle plate 12 can be removed from first needle plate 11 through switch operation of switching element 35 from the first position to the second position to thereby place engagement mechanism 33 in the disengaged state and moving second needle plate 12 away from first needle plate 11. This means that a single operation of switching element 35 allows disengagement and thus, the detachment of second needle plate 12 from first needle plate 11. The above described configuration simplifies the detachment of second needle plate 12 from first needle plate 11. In contrast, when switch element is in the first position, second needle plate 12 is placed in intimate contact with first needle plate 11. Further, when switching element 35 is in the first position, second needle plate 12 is reliably retained in attachment to first needle plate 11 through engagement between engagement portions 19*a* to 19*c* and engagement subject portions 32*a* to 32*c* and between rear contact portion 17*c* and clamp section 47*a*. Thus, second needle plate 12 can be reliably attached to first needle plate 11.

Switch operation of switching element 35 from the second position to the first position causes conjunctive movement of second needle plate toward the direction to be in intimate contact with first needle plate such that engagement mechanism 33 is placed in the engaged state. Likewise, switch operation of switching element 35 from the first position to the second position causes conjunctive movement of second needle plate toward the direction to move away from the first needle plate such that engagement mechanism 33 is placed in the disengaged state.

According to the above described configuration, attachment and detachment of second needle plate 12 to from first needle plate 12 can be done through the switching operation of switching element 35 from the first position to the second position. Further, the movement of second needle plate 12 can be made conjunctive with the switching operation of switching element 35 to facilitate the attachment/detachment of second needle plate 12 to/from first needle plate 11 which improves the usability of the sewing machine.

Switching element 35 includes disc 38 of operable member 37 provided at one of first needle plate 11 and second needle plate 12, activation cam 39 moving conjunctively with disc 38, and contact member 16 provided on the remaining other of the needle plates 11 and 12 and being placed in contact with activation cam 39. Disc 38 provided at operable member 37 moves in conjunction with activation cam 39 which is placed in contact with contact member 16. The change in contact position of activation cam 39 in coordination with the switching of operable member 37 between the first position and the second position causes the approximation/separation of second needle plate 12 to/from first needle plate 11.

According to such configuration, switching element 35 places second needle plate 12 in intimate contact with or spaced away from first needle plate 11 through change in the contact position of activation cam 39 relative to contact member 16 which is caused by the switch operation of operable member 37 by the user. The above is rendered in a simple structure of disc 38, activation cam 39, and contact member 16. Further, second needle plate 12 can be removed from first needle plate 11 only when engagement mechanism 33 is disengaged by the user operation of operable member 37.

Switching element 35 according to the first exemplary embodiment is configured to detachably attach second needle plate 12 to first needle plate 11 through the operation of cam mechanism 44, thereby smoothly and reliably attaching/detaching second needle plate 12 to/from first needle plate 11 by way of activation cam 39. Operable member 37 and retaining member 47 provided on first needle plate 11 and contact member 16 provided on second needle plate 12 are interchangeable, meaning that the former may be provided on second needle plate 12 and the later may be provided on first needle plate 11.

Switching element 35 is provided between either of needle plates 11, 12 and operable member 37, and is provided with retaining member 47 that retains operable member 37 either in the first position or the second position.

According to such configuration, second needle plate 12 can be locked in intimate contact with first needle plate 11 by placing operable member 37 in the first position to reliably attach second needle plate 12 to first needle plate 11. By placing operable member 37 in the second position, second needle plate 12 can be reliably disengaged from first needle plate 11 to allow second needle plate 12 to be separated from first needle plate 11. Thus, attachment/detachment of second needle plate 12 to/from first needle plate 11 can be made easier.

Upper surface 37*a* of operable member 37 is configured to be level with the upper surface of second needle plate 12 to obtain a flat and smooth surface which prevents the workpiece cloth from being caught on needle plate 10 when placed on needle plate 10 typically during a sewing operation, thereby improving the work efficiency by eliminating such interruptions.

Operable member 37, being pivoted on either of needle plates 11 and 12, allows attachment/detachment of second needle plate 12 to/from first needle plate by rotary operation, which simplifies the structure of switching element 35 as well as improving operability.

Recess 38*a* provided on upper surface 37*a* of operable member 37 allows turning of operable member 37 through use of a tool, thereby further facilitating attachment/detachment of second needle plate 12 to/from first needle plate 11.

Figure 11A:
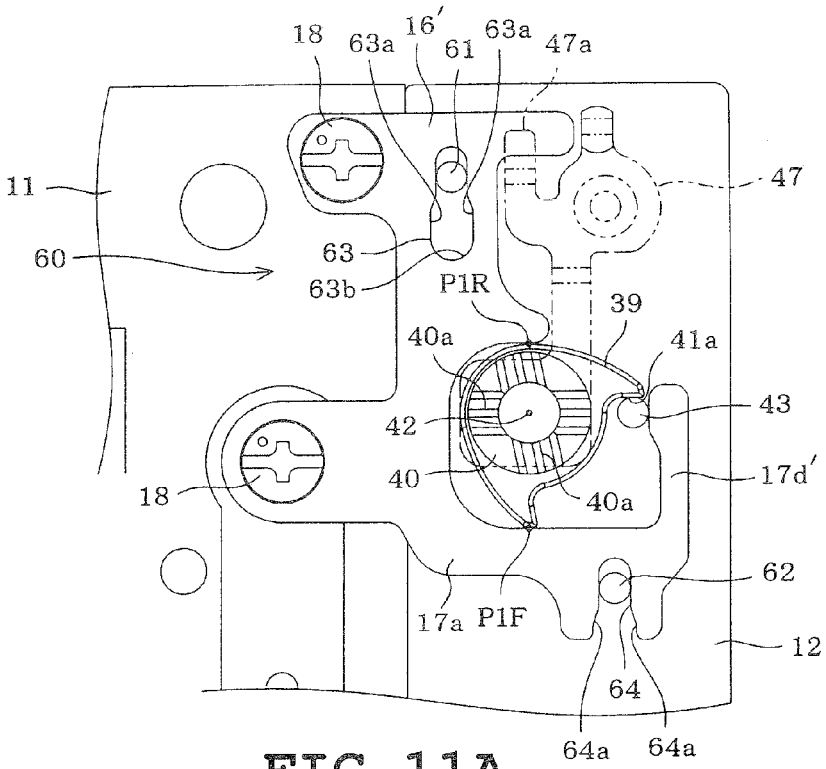
FIGS. 11A and 11B illustrate a second exemplary embodiment of the present disclosure and corresponds to FIGS. 10A and 10B.
Figure 11B:
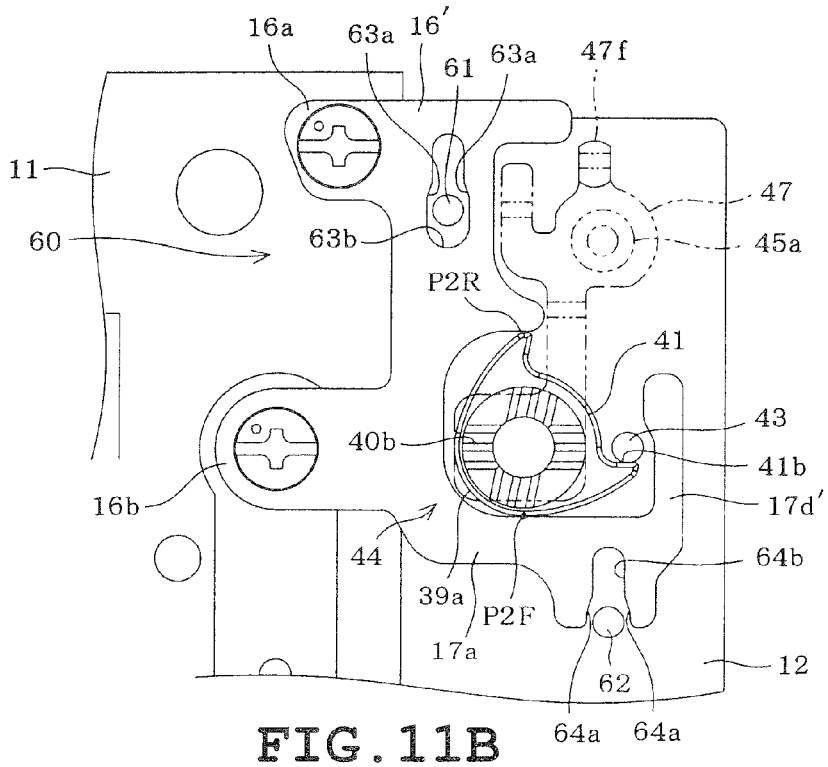

FIGS. 11A and 11B indicate a second exemplary embodiment of the present disclosure. Description will be given hereinafter on the differences from the first exemplary embodiment. The elements that are identical or similar to those of the first exemplary embodiment will be represented by identical reference symbols.

Switching element 60 according to the second exemplary embodiment differs from switching element 35 of the first exemplary embodiment as described below. On the underside of second needle plate 12, a couple of embosses 61 and 62 are provided in addition to emboss 43. Both embosses 61 and 62 are identical in shape to emboss 43 and are structurally integral with second needle plate 12. Emboss 61 is provided on the rear end side of second needle plate 12, whereas emboss 62 is located forward relative to emboss 43. Emboss 61 is provided on one lateral side of second needle plate 12 relatively closer to first needle plate 11, whereas emboss 62 is provided on the opposing other lateral side of second needle plate 12 relatively distant from first needle plate 11.

Embosses 61 and 62 are inserted through guide sections 63 and 64 provided on contact member 16'. Guide section 63 is located at the rear end side of contact member 16, whereas guide section 64 is located forward relative to forward contact section 17*a*. Guide section 63 is generally shaped as a long hole to allow insertion of emboss 61. The length of guide section 63 running longitudinally is dimensioned slightly longer than distance L to allow longitudinal movement of second needle plate 12. Guide section 63 is provided with a pair of slopes 63*a* and 63*a* spreading forward that increases the width of guide section 63 in the forward direction. Guide section 64, on the other hand, is formed as an opening that is opened forward to exhibit a forwardly protruding bifurcation at forward contact section 17*a*. Guide section 64 is provided with a pair of forwardly spreading slopes 64*a* and 64*a* that are located at the forward tip of the bifurcation and that increase the width of guide section 64 in the forward direction. Contact member 16' according to the second exemplary embodiment is provided with guide tip 17*d*' which is relatively thicker as compared to guide tip 17*d* of the first exemplary embodiment.

According to the above described switching element 60, switching of operable member 37 from the second position to the first position causes second needle 12 to be guided by inner walls 63*b* and 64*b* of guide sections 63 and 64 by way of embosses 61 and 62. Thus, when operable member 37 is placed at the first position as shown in FIG. 11A, first needle plate 11 can be placed in intimate gapless contact with second needle plate 12. Especially because of the forwardly spreading pairs of slopes 63*a*, 63*a* and 64*a*, 64*a*, embosses 61 and 62 can be guided accurately and smoothly during the process of attaching second needle plate 12 to first needle plate 11 to facilitate the detachment of second needle plate 12 from first needle plate 11 on the part of the user.

FIGS. 12A to 15B indicate a third exemplary embodiment of the present disclosure. Description will be given hereinafter on the differences from the first exemplary embodiment. The elements that are identical or similar to those of the first exemplary embodiment will be represented by identical reference symbols.

Figure 12A:
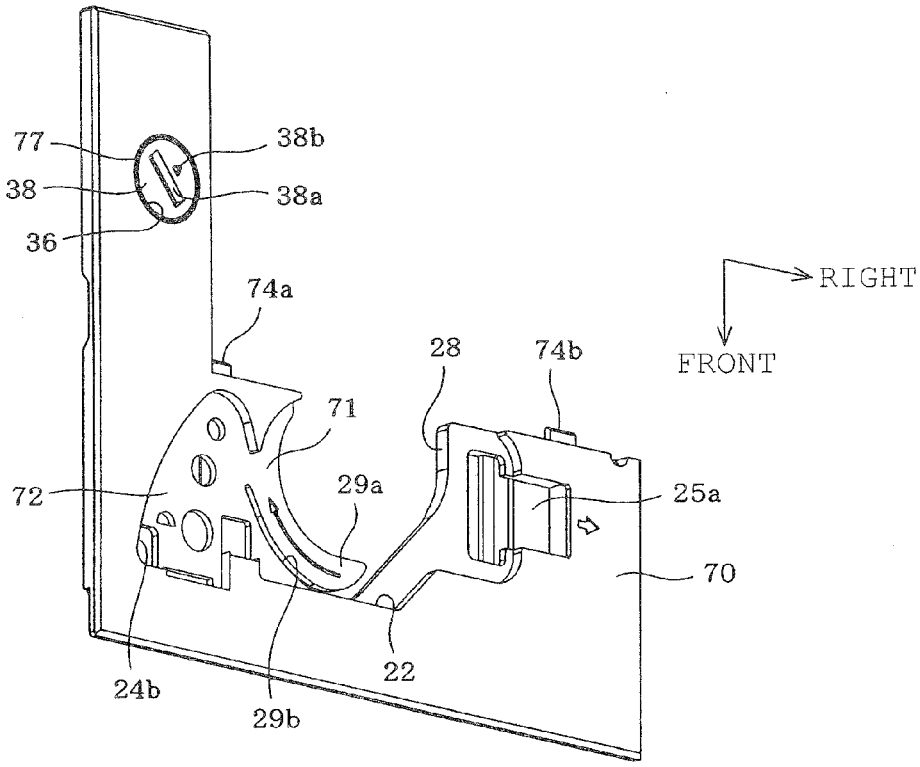
FIGS. 12A and 12B illustrate a third exemplary embodiment of the present disclosure and provide perspective views of the top surface and the bottom surface of the second needle plate and the switching element.
Figure 12B:
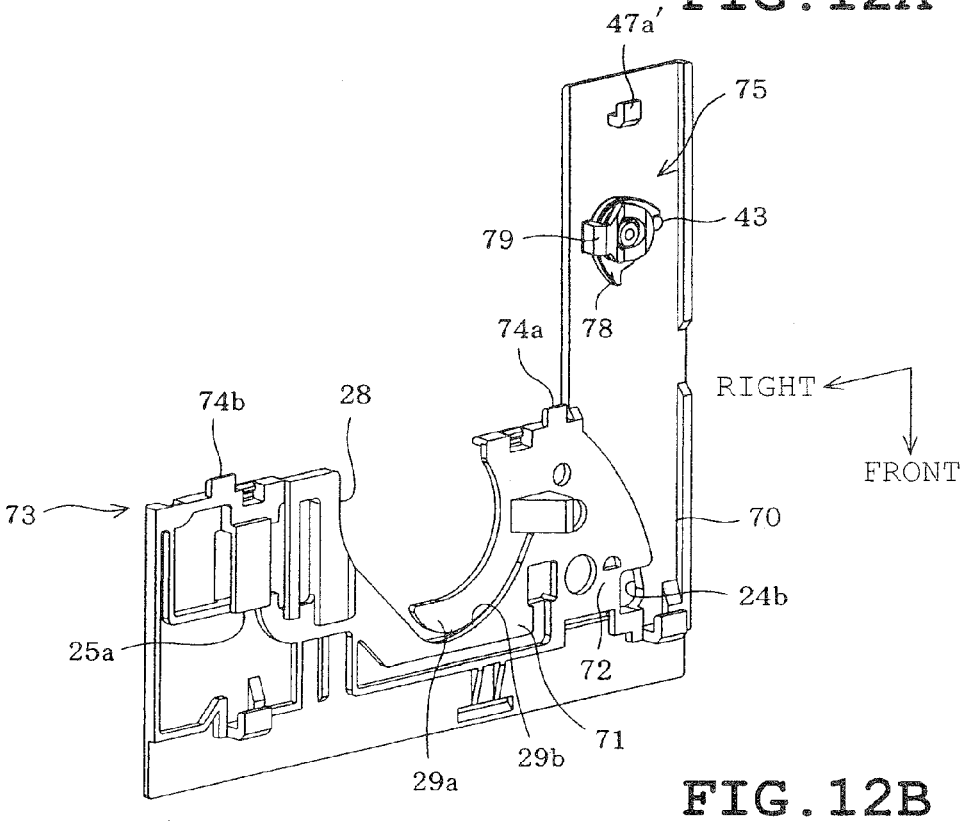

Second needle plate 70 according to the third exemplary embodiment is made entirely of synthetic resin material and lacks components such as the pair of guide plates 24 and 25 and screws 26 and 27 provided in second needle plate 12 of the first exemplary embodiment. As can be seen in FIGS. 12A and 12B, second needle plate 70 is provided with guide plate 71 that replaces the pair of guide plates 24 and 25 and retaining member attachment 72 that replaces retaining member attachment 25*a* that are molded integrally with second needle plate 70 by injection molding. As shown in FIG. 13B, clamp section 47*a* of the first exemplary embodiment is replaced by an L-shaped clamp section 47*a*' which is structurally integral with the underside of second needle plate 70. Clamp section 47*a*' is an element of engagement mechanism 73 of the third exemplary embodiment for clamping rear side contact section 17*c* of contact member 16. As further shown in FIGS. 12A and 12B, engagement mechanism 73 according to the third exemplary embodiment is provided with a pair of left and right support tongues 74*a* and 74*b* that are located at the rear edge of second needle plate 70. Support tongues 74*a* and 74*b* supports the front edge or the engagement section of first needle plate 11 at the under side of second needle plate 70 to lock first needle plate 11 in place. FIGS. 12A and 12B illustrate second needle plate 70 with needle plate lid 23, retainer member 30, and cover 31 removed.

Figure 13A:
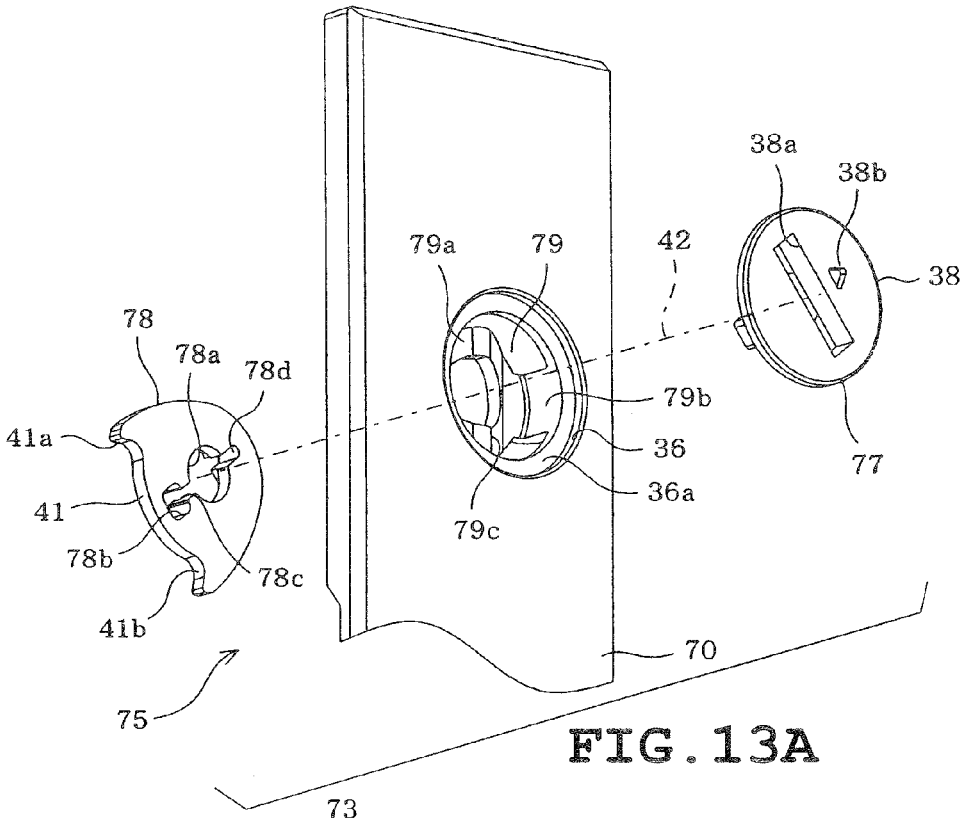
FIGS. 13A and 13B are enlarged exploded perspective views of the top surface and the bottom surface of the switching element at the second needle plate.
Figure 13B:
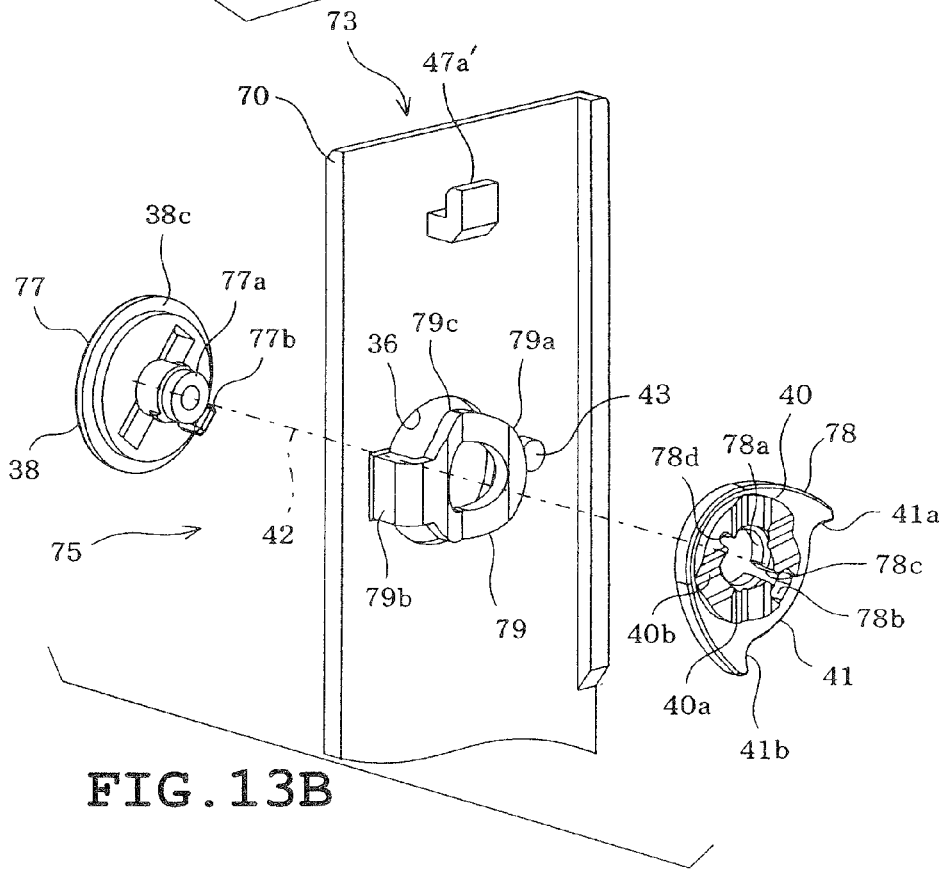
Figure 14A:
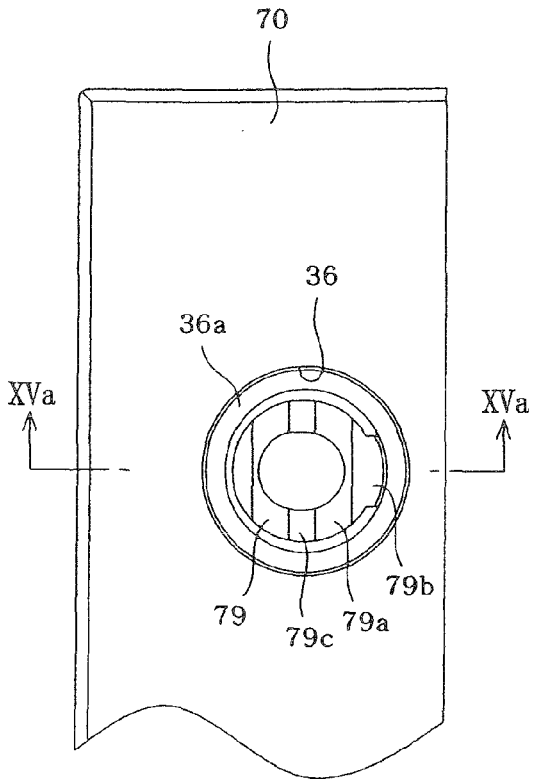
FIGS. 14A and 14B are enlarged partial plan views taken from the top side and the bottom side of the switching element at the second needle plate.
Figure 14B:
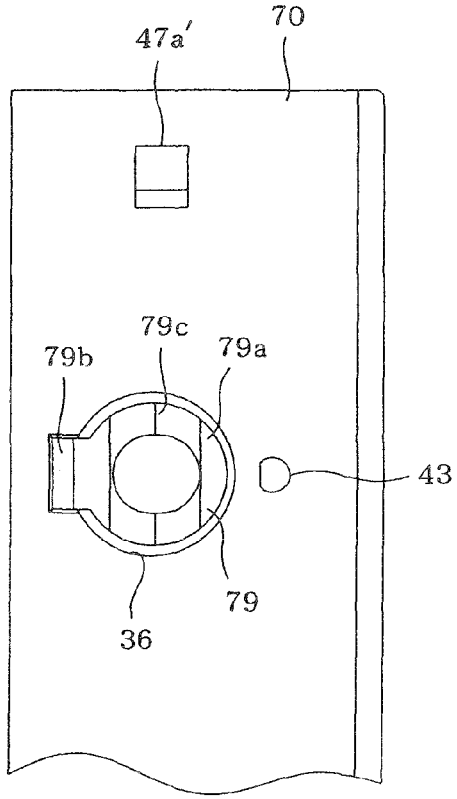
Figure 15A:
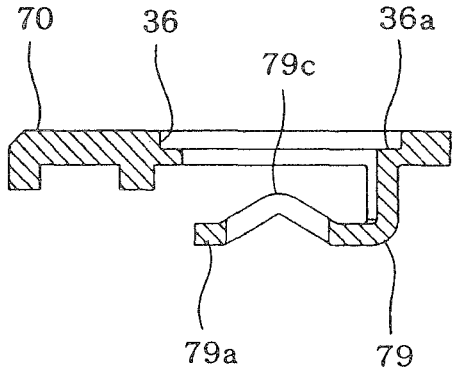
FIG. 15A is a cross sectional view taken along line XVa-XVb of FIG. 14A.

Referring to FIGS. 13A and 15A, attachment hole 36 of second needle plate 70 is subdivided into an upper half section and a lower half section. The lower half section is provided with a stepped support section 36*a* which reduces the diameter of the lower half section as compared to the upper half section.

Switching element 75 according to the third exemplary embodiment is configured such that operable member 77 and activation cam 78 are configured as separate components and retaining member 79 is structurally integral with second needle plate 70 as shown in FIG. 13B. More specifically, disc 38 of operable member 77 is provided with a stepped support subject 38*c* which is supported by support section 36*a* of attachment hole 36. On the underside center of disc 38, a generally cylindrical protrusion 77*a* is formed which is structurally integral with disc 38. Beside protrusion 77*a*, auxiliary protrusion 77*b* is formed which is also generally cylindrical in form and structurally integral with disc 38. Activation cam 78 is substantially identical in form with activation cam 39 of the first exemplary embodiment. Activation cam 78 is provided with recess 78*a* and auxiliary recess 78*b* which are mated with protrusion 77*a* and auxiliary protrusion 77*b* respectively. Recess 78*a* and auxiliary recess 78*b* are slightly smaller in size as compared to protrusion 77*a* and auxiliary protrusion 77*b*. Further, activation cam 78 is provided with slits 78*c* and 78*d*. Slits 78*c* and 78*d* extend in the direction to interconnect protrusion 77*a* and auxiliary protrusion 77*b*. As later described in detail, protrusion 77*a* and auxiliary protrusion 77*b* are pressed into fitting engagement with the corresponding recess 78*a* and auxiliary recess 78*b*. At this instance, because slits 78*c* and 78*d* slightly spread out, projection 77*a* and auxiliary projection 77*b* are pressed into fitting engagement with recess 78*a* and auxiliary recess 78*b* with light pressure. On the underside of activation cam 78 retaining subject 40 is provided which is structurally integral with activation cam 78. Though operable member 77 and activation cam 78 are configured as separate components, they are made of the same resin material as second needle plate 70.

As shown in FIGS. 14A to 15B retaining member 79 includes annular section 79*a* and bridge 79*b*. Annular section 79*a* is concentric with attachment hole 36 and is located below the underside of second needle plate 70. Bridge 79*b* connects the outer edge of annular section 79*a* with the inner edge of attachment hole 36. As typically shown in FIG. 158, annular section 79*a* is provided with a projection implemented as ridge 79*c* that is placed in selective fitting engagement with grooves 40*a* or 40*b* of retaining subject 40. The fitting engagement of ridge 79*c* and grooves 40*a* or 40*b* may be perceived typically as a clicking, thereby locking retaining subject 40 and consequently operable member 77 in the first position or the second position. Though not shown in detail, bridge 79*b* made of resin material is bendable and thus, bends downward by elastic deformation to the extent that ridge 79*c* of annular section 79*a* is disengaged from groove 40*a* or 40*b* to allow turning of operable member 77.

Figure 15B:
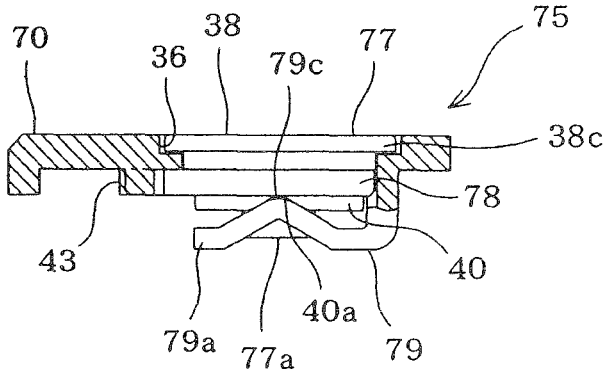
FIG. 15B is a partially broken view of an assembly of the switching element.

Attachment of switching element 75 to second needle plate 70 begins with laterally inserting activation cam 78 between second needle plate 70 and annular section 79*a*. Then, protrusion 77*a* and auxiliary protrusion 77*b* of operable member 77 are pressed into fitting engagement with recess 78*a* and auxiliary recess 78*b* from the top side of second needle plate 70. Thus, operable member 77 and activation cam 78 are rotatably supported by support section 36*a* of attachment hole 36 as can be seen in FIG. 15B. Under this state, ridge 79*c* of annular section 79*a* is placed in selective fitting engagement with groove 40*a* or 40*b*.

According to the above described configuration, retaining member 79, clamp section 47*a*', and second needle plate 70 are made of synthetic resin material and are structurally integral which advantageously reduces number of components and cost. Further, second needle plate 70 can be reliably attached to first needle plate 11 by the working of engagement mechanism 73 and switching element 75 to provide but not limited to advantages offered by the first exemplary embodiment.

The present disclosure is not limited to the exemplary embodiments heretofore described or shown but may be modified or expanded as follows.

The needle plate described above is not limited for application in household sewing machine M but may be applied to industrial sewing machines in general. The upper surface of the operable member may be configured to be slightly lower than the upper surfaces of the first needle plate or the second needle plate. The engagement mechanism only requires that an engagement section is provided on the first needle plate and an engagement subject is provided on the second needle plate. The disengaged state of the engagement mechanism only requires that the engagement between the engagement section and the engagement subject are cancelled to allow detachment of the second needle plate from the first needle plate. Switching element 75 in its entirety including the contacting member 16 may be made of synthetic resin.

While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A needle plate configured to be placed on an upper surface of a sewing machine bed containing a horizontal hook mechanism, the needle plate comprising:

a first needle plate that is configured to be secured on the sewing machine bed and that includes a needle hole that is configured to allow penetration of a sewing needle and an angular hole allowing protruding and retracting of a feed dog that feeds a workpiece cloth;

a second needle plate that is disposed adjacent to the first needle plate and above the horizontal hook mechanism, the second needle plate being detachably attached to the first needle plate;

an engagement mechanism that includes an engagement member formed at the first needle plate and an engagement subject member formed at the second needle plate, wherein the second needle plate is retained with the first needle plate through engagement of the engagement member and the engagement subject member; and a switching element that moves the second needle plate relative to the first needle plate when switched between a first position and a second position, the second needle plate, when the switching element is in the first position, being secured in intimate contact with the first needle plate with the engagement mechanism in an engaged state, and the second needle plate, when the switching element is in the second position, being distanced from the first needle plate with the engagement mechanism in a disengaged state.

2. The needle plate according to claim 1, wherein the switching element, when operated to be switched from the second position to the first position, causes conjunctive movement of the second needle plate to establish intimate contact with the first needle plate such that the engagement mechanism is placed in an engaged state, and when operated to be switched from the first position to the second position, causes conjunctive movement of the second needle plate to move away from the first needle plate such that the engagement mechanism is placed in a disengaged state.

3. The needle plate according to claim 1, wherein the switching element further comprises:

an operable member that is provided at either of the first and the second needle plates and that is switched between the first position and the second position by user operation, an activation member that is configured to move conjunctively with the operable member, and a contact member that is provided on remaining other of the first and the second needle plates and that contacts the activation member; and wherein the activation member changes its position of contact with the contact member in conjunction with the switching of the operable member between the first position and the second position to place the second needle plate in intimate contact with the first needle plate and to move the second needle plate away from the first needle plate.

4. The needle plate according to claim 3, wherein the switching element further comprises a retaining member that is provided between either of the first or the second needle plate and the operable member or the activation member and that is configured to retain the operable member in the first position and the second position.

5. The needle plate according to claim 3, wherein an upper surface of the operable member is flush with or lower than an upper surface of the first or the second needle plate.

6. The needle plate according to claim 3, wherein the operable member is supported rotatably relative to the first or the second needle plate.

7. The needle plate according to claim 6, wherein the operable member has a recess defined on an upper surface thereof for insertion of a tool for rotating the operable member.

8. The needle plate according to claim 1, wherein the second needle plate and a part of or all of the switching element is made of a synthetic resin material.

9. A sewing machine comprising:

a sewing machine bed that contains a horizontal hook mechanism; and a needle plate configured to be placed on an upper surface of the sewing machine bed, the needle plate including:

a first needle plate that is configured to be secured on the sewing machine bed and that includes a needle hole that is configured to allow penetration of a sewing needle and an angular hole allowing protruding and retracting of a feed dog that feeds a workpiece cloth;

a second needle plate that is disposed adjacent to the first needle plate and above the horizontal hook mechanism, the second needle plate being detachably attached to the first needle plate;

an engagement mechanism that includes an engagement member formed at the first needle plate and an engagement subject member formed at the second needle plate, wherein the second needle plate is retained with the first needle plate through engagement of the engagement member and the engagement subject member; and a switching element that moves the second needle plate relative to the first needle plate when switched between a first position and a second position, the second needle plate, when the switching element is in the first position, being secured in intimate contact with the first needle plate with the engagement mechanism in an engaged state, and the second needle plate, when the switching element is in the second position, being distanced from the first needle plate with the engagement mechanism in a disengaged state.

* * * * *